US005340110A

United States Patent [19]

Mollis

[11] Patent Number: 5,340,110

[45] Date of Patent: Aug. 23, 1994

[54] FIRM-GRIP SWING TRAINER

[76] Inventor: Michael Mollis, 1375 Jamaica Rd., Marco Island, Naples, Fla. 33937

[21] Appl. No.: 72,113

[22] Filed: Jun. 7, 1993

[51] Int. Cl.[5] ..... A63B 69/36

[52] U.S. Cl. ..... 273/187.2; 273/189 R

[58] Field of Search ..... 273/187.2, 191 B, 188 R, 273/187.4, 187.5, 189 R; 434/252

[56] References Cited

U.S. PATENT DOCUMENTS

| | | | |
|---|---|---|---|
| Re. 28,661 | 12/1975 | Tredway | 273/183 |
| 2,498,006 | 2/1950 | Ridill | 273/189 R |
| 3,111,322 | 11/1963 | English | 273/35 |
| 3,677,543 | 7/1972 | Richardson | 273/191 B X |
| 3,680,869 | 8/1972 | Brady | 273/183 |
| 3,861,668 | 1/1975 | Butler | 273/183 |
| 4,173,344 | 11/1979 | Angshed | 273/189 R X |
| 4,895,373 | 1/1990 | Richman | 273/189 R X |
| 5,042,811 | 8/1991 | D'Amico | 273/165 |
| 5,062,642 | 11/1992 | Berry et al. | 273/183 |
| 5,149,099 | 9/1992 | Radakovich | 273/189 R |
| 5,188,366 | 2/1993 | Dorotinsky et al. | 273/188 R |

*Primary Examiner*—George J. Marlo
*Attorney, Agent, or Firm*—Donald Watkins

[57] ABSTRACT

A device for training golfers to establish and maintain a firm grip on the golf club during the back swing, throughout the swing and follow-through comprising an elastic cord, attached at one end of the cord to the foot of the golfer, a tab attached to the other end of the cord designed to be tucked between the golf club and the heel of the upper hand on the golf club.

10 Claims, 5 Drawing Sheets

FIRM-GRIP SWING TRAINER

BACKGROUND OF THE INVENTION

One of the major problems in executing a good golf swing is maintaining a firm grip on the golf club throughout the swing from start to finish. It is common among golfers to allow the club to separate from the hands by a small distance at various positions in the swing. It is most difficult for a golf professional to explain just how firmly to hold the club because the golfer cannot perceive that he is releasing his grip. Even low handicap golfers or golf professionals hit misdirected balls and may not have any understanding of what has gone wrong. Usually, it is a result of relaxing the grip and allowing the club to move within his grip. This is commonly called "regripping". There are various points throughout the golf swing where golfers unconsciously release theft grip pressure which produces errors in the golf shot. The present invention is not only designed to produce the proper grip pressure without choking the club but also allows the golfer to determine the exact point in his swing where he may be releasing the proper grip pressure. Nothing in the prior art even remotely attempts to monitor the golf grip during the golf swing.

DESCRIPTION OF THE PRIOR ART

There are devices in the prior art, such as formed grips, which teach golfers how and where to place theft hands on a golf club but none that evaluate the grip pressure and the continuity of a proper grip throughout the swing. English (U.S. Pat. No. 3,111,322) teaches a grip training device which indicates when finger pressure on a golf club is excessive. In the instant invention it is the pressure of the heel of the hand on the club which is monitored as this is the point of the grip that separates from the club when proper pressure is not maintained. Ridill (U.S. Pat. No. 2,498,006) shows a device which teaches proper swinging motion by creating various tensions on the body at different positions in the swing. He actually shows attaching an elastic member to the left foot and the left wrist. Nothing is shown which would indicate "regripping". Radakovich (U.S. Pat. No. 5,149,099) discloses hooking an elastic member to the golfers shoulders which hooks onto his thumb to train him in alignment and swing control. Berry et al (U.S. Pat. No. 5,062,642) shows stirrups hooked to the feet and waist of a golfer to strengthen and train the legs. D'Amico (U.S. Pat. No. 5,042,811) uses a device attached to a club to teach proper grip of the thumb and forefinger. Tredway (U.S. Re. 28,661) uses a golf glove with a light to teach moving the hands in the proper arc during the golf swing. Butler (U.S. Pat. No. 3,861,688) simply shows a warning device to teach proper hand position relative to the body during the golf swing. Brady (U.S. Pat. No. 3,680,869) shows a non-stretchable cord attached to the leg and wrist of a golfer to teach proper body turn and weight shift. Nowhere in the prior art is there a showing of placing a tab between the heel of a golfer's hand and a golf club and using a tensioned strap or cord to pull the tab from the grip area if the grip pressure is released.

SUMMARY OF THE INVENTION

The firm grip-swing training device disclosed herein is designed to overcome the common fault of releasing the pressure between the heel of the left hand and the golf club at any point during the golf swing. This unique training aid keeps the hands and the golf club connected throughout the whole swing process. Hereafter all reference will be made to right handed golfers and it is understood that the terms left and right can be interchanged to accommodate left handed golfers. This device includes an elastic strap or cord which is attached at one end of the left or leading foot and at the other end has a strip of material which is tucked between the heel of the left or leading hand and the golf grip as the hands are placed on the club. If proper hand pressure is maintained on the club throughout the golf swing, the strip of material stays in place. If grip pressure is released at any point in the swing, the strip of material will be pulled out by the elastic strap or cord and the golfer becomes aware of the exact point where he is releasing his grip. Because it is important not to grip the club too tightly, the golfer can experiment with the device by relaxing his grip until the strip of material is just released and is pulled from between his hand and the club. Then, he can increase his grip pressure to insure that there is no release and the material stays in place. When the golfer learns to grip the club properly by using this device, it will be much easier for him to learn the other fundamentals of a gold swing.

DESCRIPTION OF THE INVENTION

Figure 1:
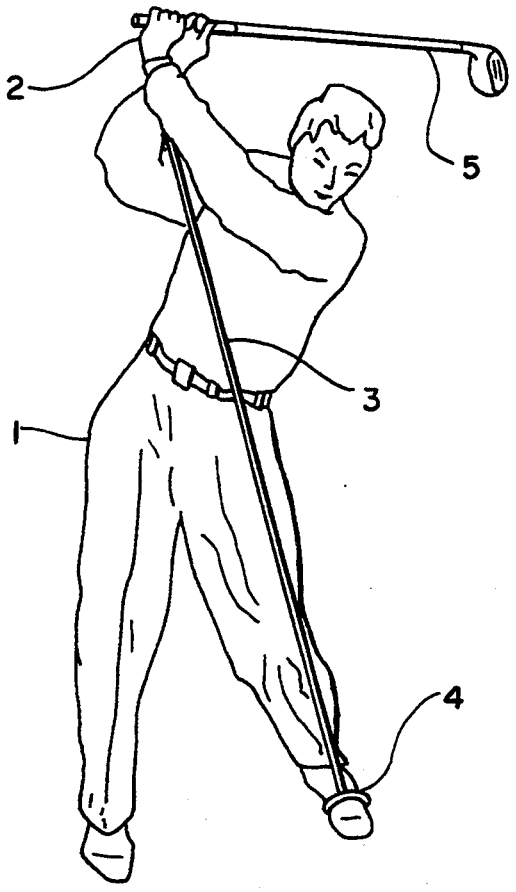
FIG. 1 is a perspective view of golfer with grip trainer in place at the top of the backswing.
Figure 5:
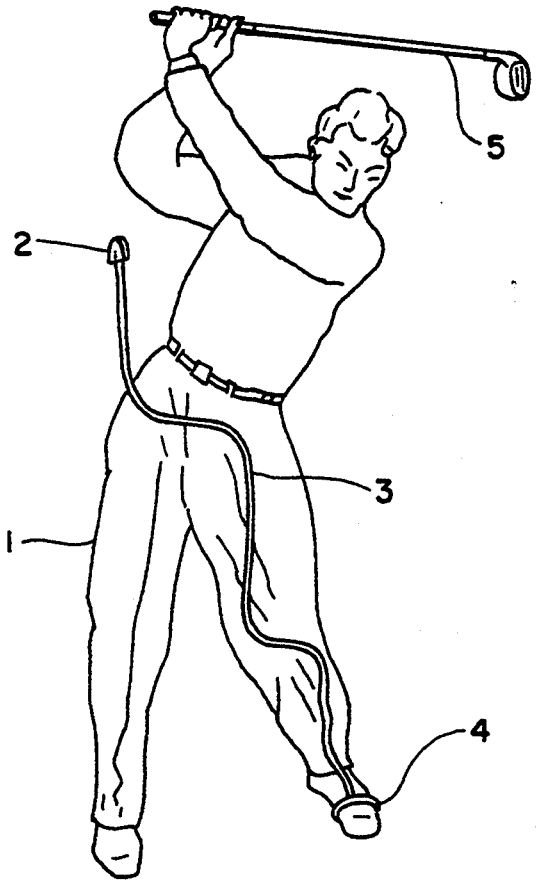
FIG. 5 shows the grip training device being pulled from between the club and the hand when grip pressure is released.

The grip training device of this invention consists of a loop 4 which is wrapped around the left or leading foot, an extensible cord 3 attached to the loop 4 and having small strip of material 2 attached to the other end of the cord. The length of cord 3, which may be adjustable, is such that even at address there is a slight tension in the cord. As the golfer 1, shown in FIG. 1, turns to complete his backswing the tension in the cord increases because the cord 3 is stretched. If the golfer fails to maintain his grip on the golf club 5 the strip of material 2 will be pulled from between his hand and the grip 11 on club 5 as is best seen in FIG. 5. Because the cord 3 is under tension at all times throughout the golf swing, it is possible to determine any point in the golf swing where grip pressure is relaxed.

Figure 2:
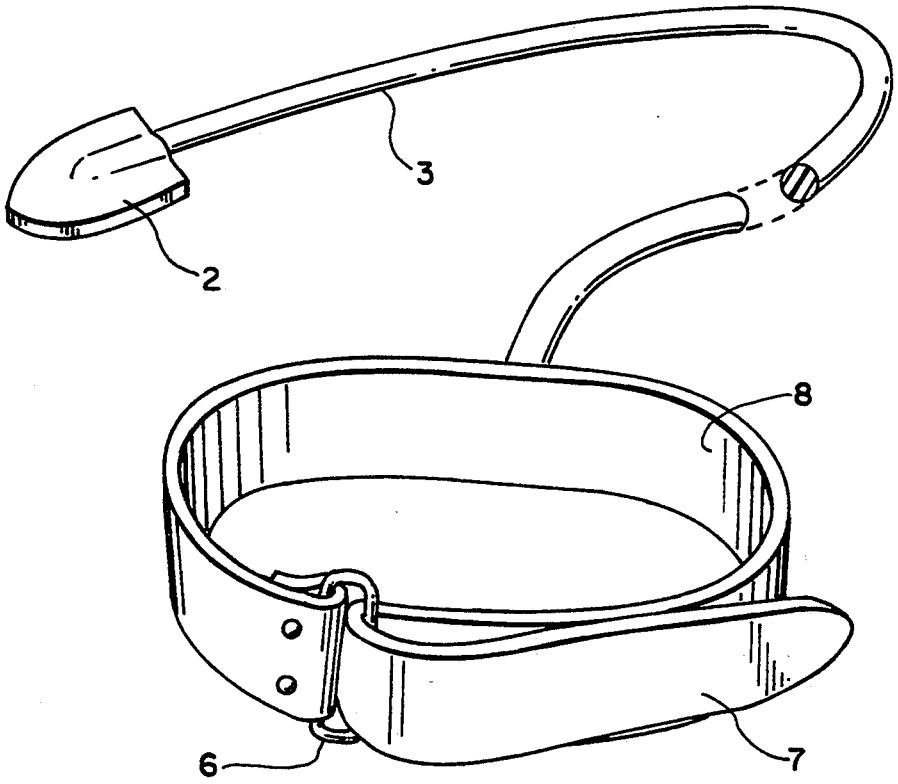
FIG. 2 shows the grip training device with a loop for attachment to the left foot and having a VELCRO attachment means.
Figure 3:
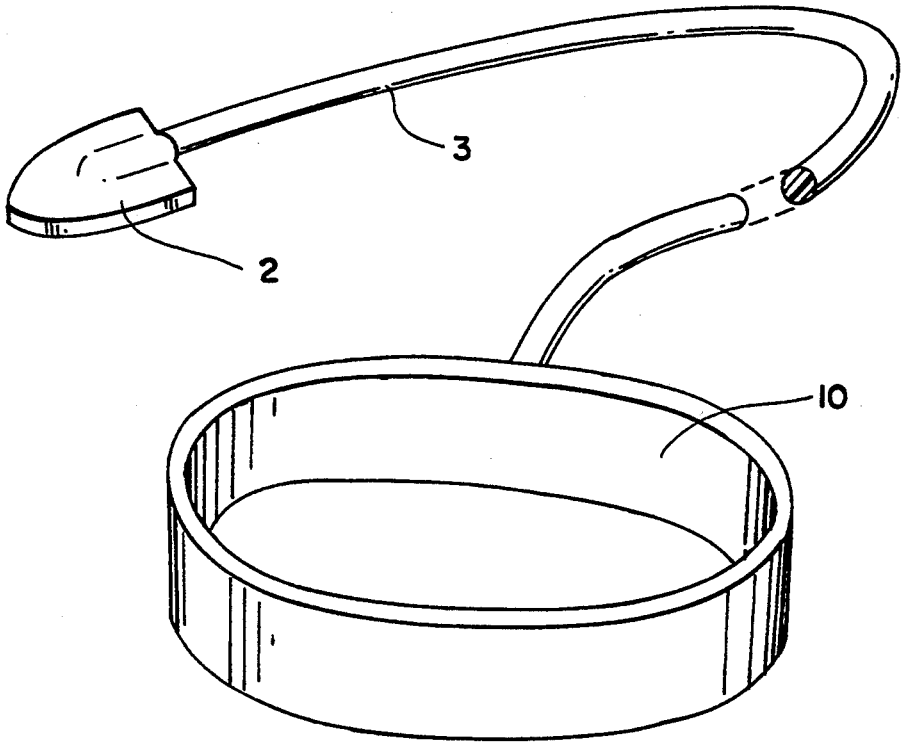
FIG. 3 shows a grip training device with a continuous loop for attachment to the left foot.

In FIGS. 2 and 3 are two simplified views of straps or loops (8,10) which the golfer may use to attach the device to his foot. A VELCRO strap 7 and D-ring 6 may be employed or simply a loop on the end of the extensible member 3 may be used. It is obvious that any loop forming means may be used and any type of closure means such as VELCRO or buckles, etc. may be used. The means for attaching the cord to the loop can include D-rings or circular rings (not shown) or any known means for attaching ends of cords to cooperating means. While not shown in the drawings, it is envisioned that the length of cord 3 may be adjustable or in fact may be provided in varying lengths to accommodate golfers of varying heights. The tab 2 may be made of leather, plastic or other fabric material and should fit comfortably between the hand and the grip of the golf club without creating a bulge or bump that would interefere with the proper gripping of the club.

Figure 4:
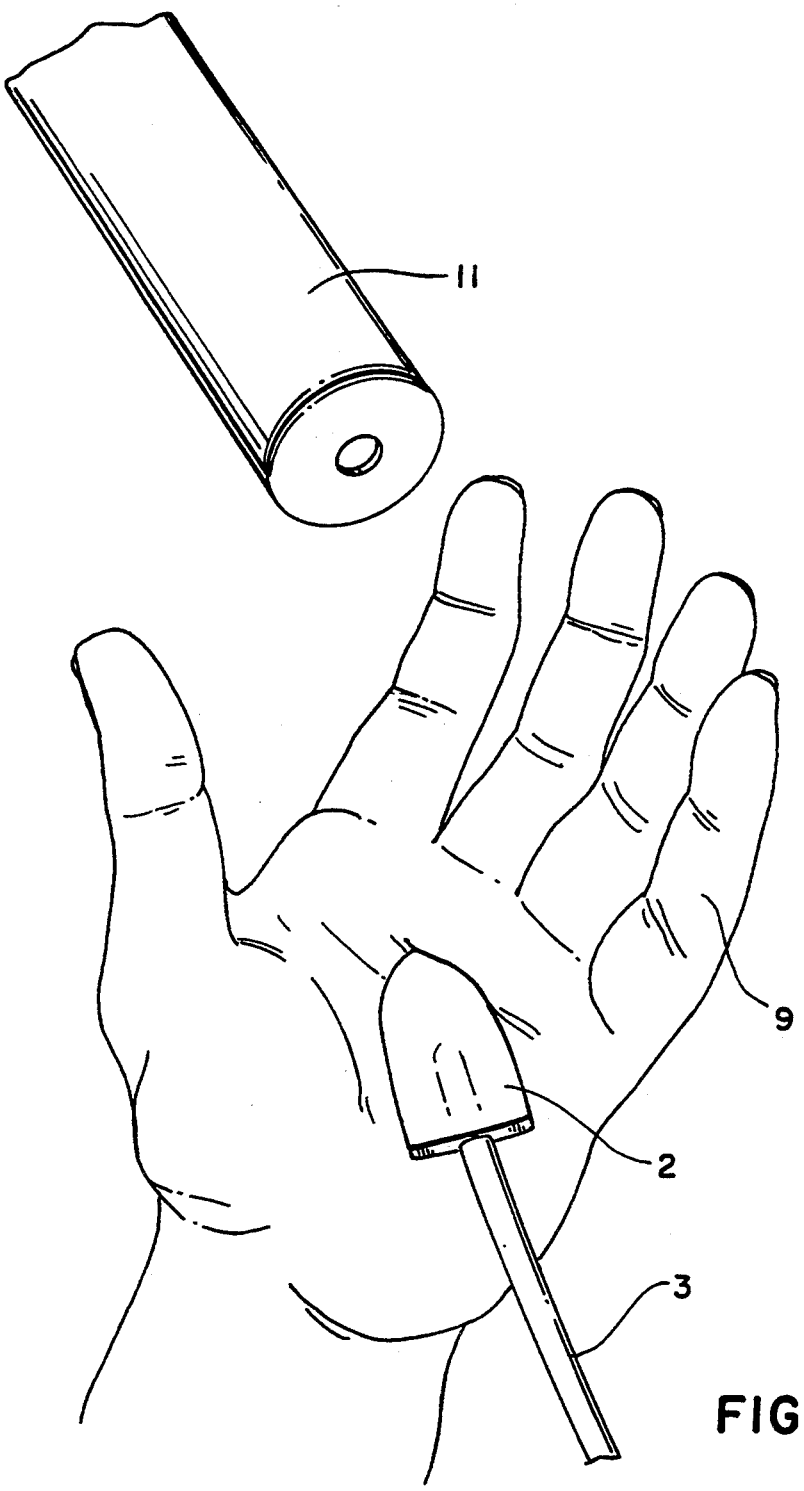
FIG. 4 is an exploded view showing the tab of the grip training device positioned in the hand in preparation for gripping the club.

The manner in which the tab means is placed between the hand and the golf grip is best shown in FIG. 4. The tab 2 at the end of cord or strap 3 is placed near the heel of the hand and the golf grip 11 is then placed over the tab 2 and the hand is then closed around the golf grip. Thereafter, the golf swing is executed and if proper grip pressure is maintained, the tab 2 will remain in place and not be pulled from between the hand and the grip 11. If the grip is relaxed, the tension in the cord or strap 3 will pull the tab from between the hand and the grip and the golfer will be aware of the point at which the grip was relaxed and can then concentrate on maintaining the proper grip pressure.

Proper grip pressure is one of the most important and fundamental factors in executing a golf swing. However, in addition to teaching proper grip pressure, the instant invention will also permit the golfer to determine whether or not he is making a complete body turn during the backswing and during the follow through. After making just a few complete golf swings, the golfer will learn what the tension level of the cord or strap would be during a complete turn and he will begin to "feel" whether or not he has made the complete turn and follow through. While the device of the instant invention can be used by an individual in teaching himself proper grip pressure and maintenance of the proper grip throughout the swing, it will also be valuable for golf professionals teaching students to execute proper grip pressure and swing. The professional will be able to demonstrate and emphasize what he means when he tells the student that he is letting the club move in his hands and be able to show the student exactly where in his swing he is releasing the grip.

While the firm-grip swing trainer has been described it is understood that changes may be made in the design, materials and arrangement of parts without departing from the scope of the invention which is only limited by the claims attached.

I claim:

1. A firm-grip training device for golfers consisting essentially of an elastic cord having a predetermined length including first and second ends, means for forming a loop connected to said first end of said cord for receiving a golfer's leading foot while in a proper stance holding a golf club and addressing a golf ball, a strip of material connected to said second end of said cord for fitting comfortably between the heel of the leading hand of the golfer and the grip of said golf club without interfering with the proper gripping of said grip, the length of said cord being such that when a golfer is in the golf ball address position, with said strip of material located between the leading hand and the club grip, and the golfer's leading foot is in said loop, said length provides a slight tension in said cord, and as the golfer turns his body during the backswing, such tension increases in the elastic cord and, if the golfer fails to maintain an adequately firm grip which prevents the club from moving relative said leading hand, said strip will be pulled from between the golfer's hand and the club grip whereby the golfer will become aware of the exact point where the gripping pressure on said strip is being relaxed.

2. The device of claim 1 wherein said loop forming means includes a strap having a loop and hook closure means.

3. A firm-grip training device as recited in claim 2 wherein said an elastic loop forming means includes a D-ring attached to said elastic cord.

4. The device of claim 1, wherein the loop forming means includes a movable clamp means for adjustably clamping said one end of the elastic cord to itself.

5. The device of claim 1 wherein said strip of material is a flat strip of leather and is bonded to said second end of the elastic cord means.

6. The device of claim 1 wherein said strip of material is made of plastic.

7. The device of claim 1 wherein said strip of material is made of fabric material.

8. The device of claim 1 wherein said strip of material has a roughened surface.

9. The device of claim 1 wherein said elastic cord means is flat.

10. The device of claim 1 wherein said elastic cord means is round.

* * * * *